United States Patent [19]

Ikemoto

[11] 4,133,534

[45] Jan. 9, 1979

[54] BALL GAME DEVICE

[76] Inventor: Kikuji Ikemoto, 100-27 Shinnarita, Hirono-cho, Uji, Kyoto, Japan

[21] Appl. No.: 831,800

[22] Filed: Sep. 9, 1977

[51] Int. Cl.[2] ..... A63B 69/36

[52] U.S. Cl. ..... 273/176 E; 273/176 FA; 273/34 A; 273/201; 273/184 A

[58] Field of Search ..... 273/176 A, 176 E, 176 FA, 273/176 G, 176 H, 201, 181 A, 180, 34 A, 184 A

[56] References Cited

U.S. PATENT DOCUMENTS

| | | | |
|---|---|---|---|
| 2,609,199 | 9/1952 | Koener | 273/201 X |
| 3,114,555 | 12/1963 | Hurley | 273/201 X |
| 3,413,005 | 11/1968 | Stearns | 273/181 A X |
| 3,580,583 | 1/1969 | Gentiluomo | 273/176 H |
| 3,595,581 | 7/1971 | Anderson et al. | 273/176 H |

*Primary Examiner*—George J. Marlo

*Attorney, Agent, or Firm*—Morgan, Finnegan, Pine, Foley & Lee

[57] ABSTRACT

A ball game device including a plurality of hole cups each provided with a bottom plate and embedded in an undulatory game surface, a bottom plate lifting mechanism attached to each hole cup for raising and lowering the bottom plate of each hole cup, in a straight line movement, between a predetermined position below the game surface and a second position flush with the game surface, and sequence control elements for controlling the actuation of the bottom plate lifting mechanisms so that the plurality of hole cups are successively selected one at a time in such a manner that only one hole is formed in the game surface by only one hole cup thus selected each time. The sequence control elements include a holing detector photoelectric or electromagnetic induction switch associated with each of the cups.

5 Claims, 6 Drawing Figures

BALL GAME DEVICE

BACKGROUND OF THE INVENTION

The present invention relates to a ball game device for playing golf or other similar game.

A well-known ball game device of the type described comprises a plurality of holes in one end region of a substantially flat elongated game board, in which the game is played by putting a ball placed at the other end region of the game board with a putter toward the hole forming region so that the players compete with each other on the basis of their respective scores given according to the hole which the ball has entered. The well-known ball game device, however, has the disadvantage that, since the ball putting position and the ball putting line or course along which the ball rolls are substantially unchanged, there is little room for the player to use his brains in deciding the putting strength and putting direction when he hits the ball, which makes the game too simple or low-class.

SUMMARY OF THE INVENTION

An object of the present invention is to provide a high-class ball game device wherein the ball putting position and the ball rolling line are variable so that it is necessary for the player to use his brains each time he putts the ball as in an actual golf course.

Another object of the invention is to provide a ball game device which requires a relatively small overall space and yet provides a relatively large game surface.

A further object of the invention is to provide a ball game device which is suitable for training for putting in golf.

These and other objects of the invention will become apparent as the description thereof proceeds.

According to the invention, there is provided a ball game device which comprises a game surface having an undulatory feature including depressions and mounds or hillocks; a plurality of hole cups each provided with a bottom plate and distributed over and embedded in the game surface at suitable intervals; a bottom plate lifting mechanism with a drive motor attached to each hole cup for raising and lowering the bottom plate of the associated hole cup between a predetermined position where a hole is formed below the game surface and a second position where no hole is formed or where a hole is destroyed or disappears and which is flush with the game surface; at least one ball which can be rolled on the game surface and driven into a hole cup now presenting a hole; at least one putter for putting the ball to send it rolling on the game surface; and sequence control means for controlling the actuation of the drive motors of the bottom plate lifting mechanisms so that the plurality of hole cups are successively selected one at a time in such a manner that only one hole is formed in the game surface by only one hole cup thus selected each time.

The game surface may be constituted by the surface of a game board which can be installed on the floor of an existing building or on the outdoor ground, or by an existing floor itself or the ground itself.

The game surface is preferably covered with a natural or artificial turf in such a manner that some bristles are turned or inclined in the same direction. Further, the periphery of the game surface is surrounded by a frame or fence defining the game region.

Each bottom plate lifting mechanism is generally arranged so that a lifting rod having the associated bottom plate fixed to the upper end thereof is indirectly raised and lowered through a crank mechanism from a rotary drive motor such as an electric motor, a hydraulic motor or a pneumatic motor. However, the lifting rod may be adapted to be directly raised and lowered by making it integral with the piston or plunger of a direct-acting drive motor such as a hydraulic cylinder or a pneumatic cylinder.

The sequence control means preferably comprises a computer control system, and it includes a detecting circuit (detecting element) having holing detectors each associated with one of the hole cups for detecting the entry of the ball in the associated hole cup now forming or presenting a hole. The control or logic circuit of the sequence control means is so arranged that on the basis of a detection signal produced by such holing detector, it gives actuating signals to the drive motors of the bottom plate lifting mechanisms in question, whereby the bottom plate of the associated hole cup which the ball has entered is lifted to destroy the hole and concurrently therewith the bottom plate of another hole cup is lowered to the predetermined position to form a hole for the next holing out.

The sequence or order in which the plurality of hole cups are successively selected in such a manner as to form a hole in the game surface by only one hole cup each time depends upon at least one predetermined program. To this end, the control system of the sequence control means is provided with a memory circuit, a selection circuit which are associated with the program.

As for the detectors for detecting the holing of the ball, use may be made of a contact type switch, such as a microswitch, which performs its switching function by contact with the ball, and also of a non-contact type switch having a non-contact detecting head, such as a photoelectric switch and an adjacent switch, which operates without contact with the ball. However, from the standpoint of durability and operating speed, it is desirable to use the latter type. When a switch provided with an electromagnetic induction type detecting head such as an adjacent switch, which is among the non-contact type switches, is used, a ball is used which has been magnetized as by a permanent magnet embedded therein, the magnetic force of the magnet causing the switch to perform its switching function.

A ball game device embodying the present invention will now be described with reference to the accompanying drawings.

DETAILED DESCRIPTION OF THE INVENTION

Figure 1:
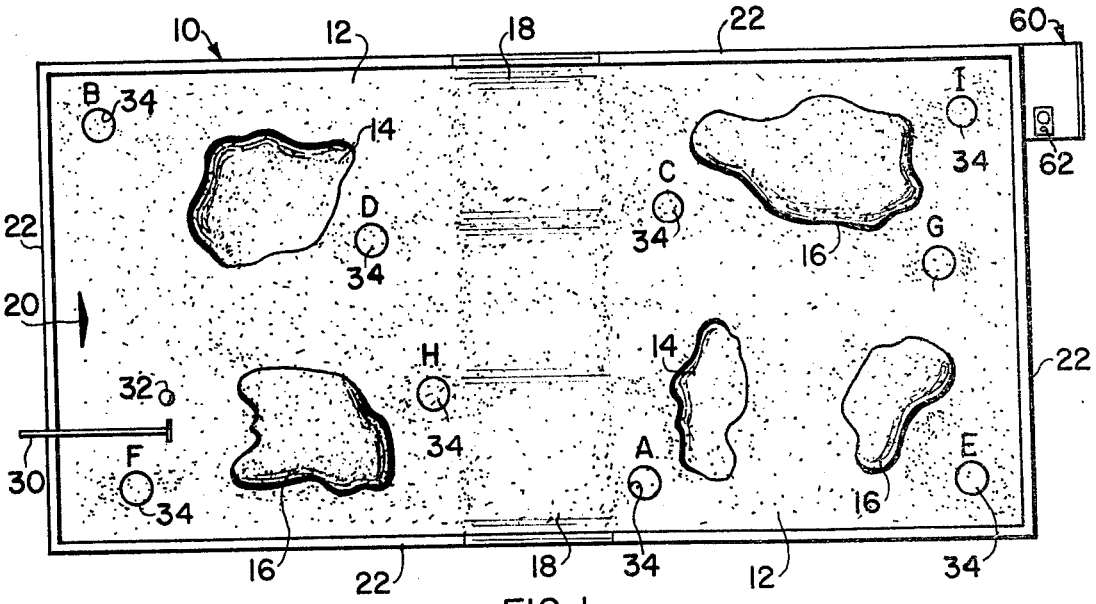
FIG. 1 is a plan view of a preferred embodiment of a ball game device according to the present invention.

Referring to the drawings, a game surface 12 constituted by the surface of a game board 10 has an artificial turf covering substantially the entire area thereof and is provided with depressions 14, mounds 16, a slope 18 and a game start mark 20. Further, a frame 22 is attached to the periphery of the game surface 12.

A plurality (nine, in FIG. 1) of cylindrical hole cups 34 capable of receiving a ball, similar to a gold ball, which will be driven for rolling on the game surface 12 by a putter 30, are distributed over and embedded in the game surface 12 at suitable intervals at positions A, B, C, D, E, F, G, H and I.

Each of these hole cups 34 is provided with a bottom plate 36 adapted to be raised and lowered by a lifting mechanism 40 shown in FIG. 2 between a predetermined position where a hole is formed below the game surface and a second position where no hole is formed and which is flush with the game surface.

Each lifting mechanism 40 includes a lifting rod 42 having the associated plate 36 fixed to the upper end thereof. The lifting rod 42 is engaged with a vertically extending guide rod 46 through a guide hole 44 formed in the lower end of the lifting rod and the other end of the lifting rod is pivotally connected with one end of a connecting rod 54 which, in turn, is pivotally supported on a crank shaft 52 adapted to be rotated integrally with the drive shaft 50 of an electric motor 48.

In this lifting mechanism 40, when the motor 48 is driven, the lifting rod 42 is moved upwardly and downwardly along the guide rod 46 through the crank shaft 52 and connecting rod 54, resulting in the lifting and lowering of the bottom plate 36.

A control box 60 installed adjacent the game board 10 contains a computer control system or circuit forming sequence control means having a circuit arranged to control the actuation of the lifting mechanism 40 so that the plurality of hole cups 34 are successively selected one at a time in such a manner that only one hole is formed in the game surface 12 by only one hole cup thus selected each time.

The sequence control means includes a detecting circuit having holing detectors each associated with one of the hole cups 34 for detecting the entry of the ball 32 in the associated hole cup 34.

Figure 2:
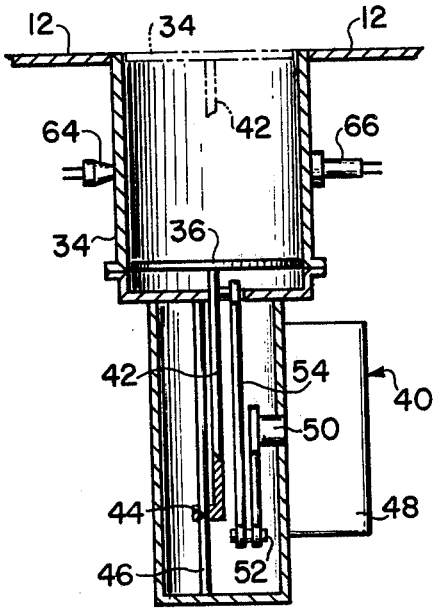
FIG. 2 is an enlarged fragmentary sectional view showing a hole cup, a bottom plate lifting mechanism and the detecting head section of a holing detector, which constitute the ball game device.
Figure 3:
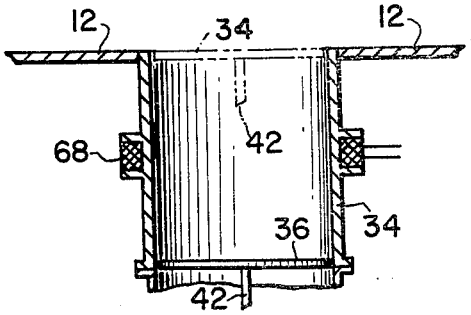
FIG. 3 is an enlarged fragmentary sectional view showing a modification of the detecting head of the holing detector.

Two different forms of such holing detector are illustrated in FIGS. 2 and 3. The holing detector shown in FIG. 2 is in the form of a so-called photoelectric switch including a detecting head comprising a source of light 64 and a photoelectric element (light receiving element) 66 which are opposed to each other with the hole cup 34 intervening therebetween, the arrangement being such that the photoelectric effect of the photoelectric element 66 is utilized to catch the ball 32 intercepting the light rays from the light source 64 when the ball rolls into the hole cup 34, thereby detecting the holing of the ball 32.

Figure 4A:
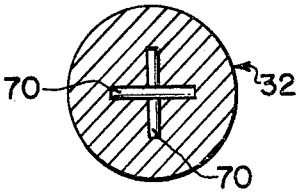
FIGS. 4*a*, 4*b* and 4*c* are enlarged views showing three embodiments of the ball used in connection with the holing detector shown in FIG. 3.
Figure 4B:
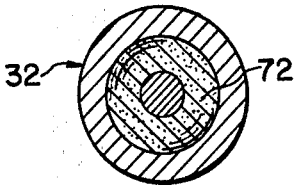
Figure 4C:
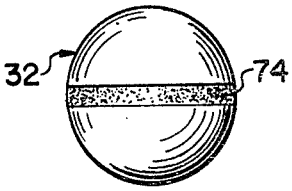

On the other hand, the holing detector shown in FIG. 3 is used with a magnetized ball 32, such as those exemplified in FIGS. 4*a*, 4*b* and 4*c*. Thus, it is in the form of an electromagnetic induction type switch (a non-contact adjacent switch) including a detecting head comprising a detecting coil 68 attached to the outer side of the hole cup 34. This type of detector detects the holing of the ball 32 by utilizing the electromotive force induced in the detecting coil 68 by electromagnetic induction when the magnetized ball 32 passes by the detecting coil 68 upon holing thereof.

The magnetization of the ball 32 is effected in FIG. 4*a* by embedding permanent magnets 70 in the ball 32, in FIG. 4*b* by winding a magnetic tape 72 inside the ball 32, and in FIG. 4*c* by applying magnetic paint 74 to the surface of the ball 32.

Further, the control system of the sequence control means includes a memory circuit, a selection and transfer circuits for sequential programs for defining the order of formation of holes by the plurality of hole cups 34.

The ball game device of the invention illustrated herein is arranged in the manner described above, and, before the game starts, it is in a state in which all of bottom plates attached to hole cups are raised to the position where is flush with the game surface 12, as shown in FIG. 1. In this device, the game is played basically in the following manner.

First of all, the player turns on a start switch 62 for the device installed on the control box 60, causing the control circuit of the sequence control means to start the control function, whereby according to a selected sequence program a bottom plate lifting mechanism 40 associated with a hole cup selected out of the plurality of hole cups 34 to be presented for the first holing out, e.g., a hole cup 34 positioned at A in FIG. 1, is actuated to lower the bottom plate 36 thereof to form a hole. Then, the player places the ball 32 at the start position 20 and putts the ball 32 with the putter 30 toward the hole cup 34 located e.g., at the position A. In this case, since depressions 14, mounds 16 and slope 18 are located on and adjacent a line extending from the start position to the hole cup 34 at the position A where a hole is formed, the player has to use his brains in deciding the putting strength and the putting direction while he keeps on putting until he successfully holes the ball 32 at the hole cup 34.

When the ball 32 is holed at the hole cup 34 where a hole is first formed in the manner described above, the holing detector attached to the hole cup 34 produces a holing detecting signal which, in turn, causes the sequence control means to produce a control signal on the basis of the selected sequence program, whereby the bottom plate lifting mechanism 40 for the hole cup 34 at which the ball 32 has been holed is actuated to lift the bottom plate 36 of the hole cup 34 with the ball 32 carried thereon until the bottom plate is flush with the game surface 12 to thereby destroy the hole, and concurrently therewith another bottom plate lifting mechanism 40 associated with a hole cup which is to be presented for the next holing out, e.g., the hole cup 34 located at B, is actuated to lower the bottom plate 36 to form a hole.

With this condition thus established, the player then putts the ball 32 with the putter 30 at a position on the hole cup 34 at which the ball was first holded and where the ball is now located, toward the hole cup 34 now presenting a hole for the second holing out.

The holing of the ball 32 is instantly detected by the holing detector associated with the hole cup 34, thus causing the sequence control means to produce a one-step-advanced control signal, whereby the bottom plate 36 of the hole cup 34 which the ball 32 has now entered is lifted with the ball carried thereon until it is flush with the game surface 12 and concurrently therewith the bottom plate 36 of a hole cup which is to be presented for the third holing out, e.g., the hole cup 34 located at C, is lowered to form a hole. Then, the player does his putting at a position on the hole cup 34 at which the ball 32 was second holed.

The process described above is repeated hereinafter. Thus, each time the ball 32 is holed, a new hole is formed by a control signal from the sequence control means, until the ball 32 enters the last hole cup 34, whereupon his game is completed.

After the player has played his game in the manner described above, he is given a score expressed in terms of the number of all putting strokes required for driving the ball 32 into all the successive hole cups 34.

When more than two players play the game, the game can be played in such a manner that the players in turn stroke their respective balls 32 with their respective putters 30 into all the holes successively formed each time a ball is holed, in other words, a player strokes his ball 32 into a hole cup 34 presenting a hole and then another player putts his ball 32 from a position where his ball is located toward a hole cup 34 presenting a new hole. In this case, after each player has played his game, the players compete with each other on the basis of their respective number of all putting strokes.

As has been described so far, the ball game device according to the present invention includes the game surface having undulations and provided with a plurality of hole cups embedded therein each having a liftable bottom plate and is arranged and constructed so that the bottom plates of these hole cups are successively selectively lowered in such a manner as to form only one at a different position on the game surface each time. Therefore, each time the player does his putting, the conditions of the putting position and the line leading to the hole are varied, thus leaving room for the player to use his brains in various ways while he is putting.

Further, according to the ball game device of the present invention, since all the plurality of hole cups except one have their bottom plates lifted to present a game surface for the ball to roll freely, it is possible to provide a broad game surface even if the overall space available is relatively small.

Also, since the undulations on the game surface provide upward and downward slopes as well as hook and slice lines, which are similar to the green of a golf course, the ball game device of the present invention can be used not only for game amusement but also for practice at putting in golf.

What is claimed is:

1. An improved ball game device having an undulatory game surface; a plurality of hole cups each provided with a bottom plate and embedded in said game surface at intervals; a bottom plate lifting mechanism associated with each of said hole cups and having a drive motor for raising and lowering the bottom plate of the associated hole cup between a predetermined position where a hole is formed below said game surface and a second position where no hole is formed and which is flush with said game surface; and sequence control means for controlling the actuation of the drive motors of said bottom plate lifting mechanisms so that the plurality of hole cups are successively selected one at a time in such a manner that only one hole is formed in said game surface by only one hole cup thus selected each time, said sequence control means including a holing detector associated with each of said hole cups for detecting the ball holing at a hole cup now presenting a hole, said sequence control means having a circuit arranged so that on the basis of a holing detection signal produced by said holing detector, the bottom plate of the hole cup which the ball has entered is raised to destroy the hole and concurrently therewith the bottom plate of another hole cup is lowered to the predetermined position to form a hole, wherein the improvement comprises a lifting rod and a straight guide rod for each of said bottom plate lifting mechanisms, each said lifting rod having the associated bottom plate fixed to the upper end thereof and being adapted to be raised and lowered by a crank mechanism, each said guide rod being adapted to restrict the movement of the associated lifting rod to a straight line path.

2. An improved ball game device as claimed in claim 1, wherein each said lifting rod comprises a vertical leg and a horizontal leg, said vertical leg being disposed in parallel relationship to the associated guide rod and said horizontal leg having an aperture through which said associated guide rod passes.

3. A ball game device as defined in claim 1, wherein said holing detectors of said sequence control means are each in the form of a non-contact type switch adapted to be without contact with said ball.

4. A ball game device as defined in claim 3, wherein said non-contact type switch comprises a photoelectric switch including a source of light and a light receiving element which are opposed to each other with the associated hole cup intervening therebetween.

5. A ball game device as defined in claim 3, wherein said non-contact type switch comprises an electromagnetic induction type switch including a detection coil attached to the outer side of the associated hole cup and said ball comprises a magnetized ball adapted to actuate said switch by electromagnetic induction.

* * * * *